United States Patent [19]

Kaplan

[11] Patent Number: 4,883,442

[45] Date of Patent: Nov. 28, 1989

[54] PREGNANT MOTHER DOLL AND SEPARABLE BABY DOLL

[75] Inventor: Ida B. Kaplan, Cincinnati, Ohio

[73] Assignee: MTR Enterprises, Cincinnati, Ohio

[21] Appl. No.: 5,208

[22] Filed: Jan. 20, 1987

[51] Int. Cl.[4] ..... A63H 3/02

[52] U.S. Cl. ..... 446/320; 446/369

[58] Field of Search ..... 446/268, 369, 295, 296, 446/320, 321; 434/262, 267

[56] References Cited

U.S. PATENT DOCUMENTS

| | | | |
|---|---|---|---|
| 1,304,434 | 5/1919 | Wingert | 446/369 |
| 1,431,482 | 10/1922 | Overholt . | |
| 2,551,433 | 5/1951 | Graves . | |
| 2,551,560 | 5/1951 | Graves . | |
| 2,619,771 | 12/1952 | Jones | 446/369 X |
| 3,812,613 | 5/1974 | Glass et al. . | |
| 4,183,171 | 1/1980 | Terzain . | |
| 4,197,670 | 4/1980 | Cox | 446/369 |
| 4,411,629 | 10/1983 | Voights | 446/295 X |

*Primary Examiner*—Mickey Yu

*Attorney, Agent, or Firm*—Wood, Herron & Evans

[57] ABSTRACT

A doll set comprising a mother doll and a baby doll which can be placed in an expansible pouch on the mother doll to impart a realistically pregnant look to the mother. When the baby doll is not in the pouch, the mother has a trim, non-pregnant appearance.

4 Claims, 1 Drawing Sheet

PREGNANT MOTHER DOLL AND SEPARABLE BABY DOLL

FIELD OF THE INVENTION

This invention relates to dolls, and more particularly, to the combination of a pregnant mother doll and a separable baby doll.

PRIOR ART

Overholt U.S. Pat. No. 1,431,482, shows a doll wherein the mother can carry a baby doll across her chest, the baby being held there by snaps. Graves U.S. Pat. Nos. 2,551,433 and 2,551,560, show mannequins for teaching midwifery, which include an abdominal cavity wherein which a baby doll can be placed for teaching purposes. A rigid cap or cover is used to provide a pregnant appearance.

Glass U.S. Pat. No. 3,812,613 shows a doll which is made to look pregnant by an internal spring mechanism which expands the abdomen.

Terzian U.S. Pat. No. 4,183,171 shows a pregnant mother doll having a cam, accessible through the back, which can be moved to change body shape to simulate a pregnant appearance and which when retracted causes the mother to have a normal appearance.

BRIEF DESCRIPTION OF THE INVENTION

In contrast to the artificial and mechanical aspects of prior art pregnant dolls, this invention provides a pregnant mother doll and an interfitting baby doll, wherein the baby doll itself, rather than some artificial mechanism, imparts the appearance of pregnancy to the mother.

The mother doll has a trunk or body which, without the baby doll, has the appearance of a woman who is not pregnant. The mother is provided with an openable but normally contracted pouch or pocket over her abdomen, which can be stretched or expanded to receive a small, conformable baby doll. The baby doll has a rounded or softly curved configuration such that, when it is placed in the pouch on the mother, it expands the pouch and imparts a smoothly curved surface to the outer (front) part of the pouch which simulates pregnancy.

Both the mother doll and the baby doll are preferably soft sculptures. The pouch preferably opens downwardly on the mother's abdomen, and is preferably provided by a body garment which fits snugly over the mother. Once removed from the mother, both the baby and the mother have realistic doll appearance and can be played with separately.

DESCRIPTION OF THE DRAWINGS

The invention can best be further described by reference to the accompanying drawings, in which.

DETAILED DESCRIPTION

Figure 1:
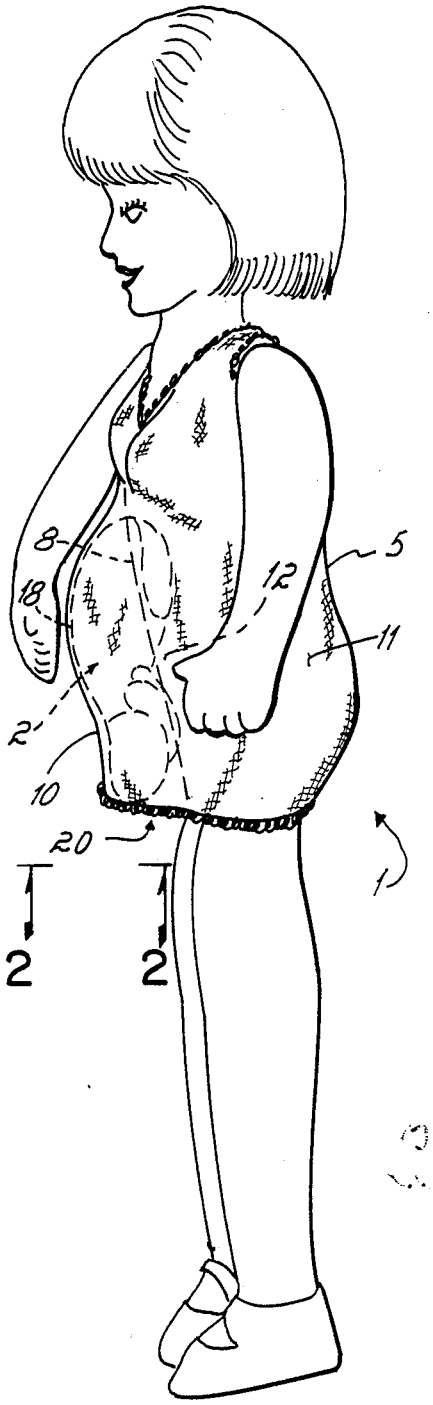
FIG. 1 is a side view of a mother doll in accordance with a preferred embodiment of the invention, showing the baby doll in phantom lines within the pouch of the mother so as to impart a pregnant look to the mother, and showing in dashed lines the profile of the mother when the baby is not in the pouch.
Figure 2:
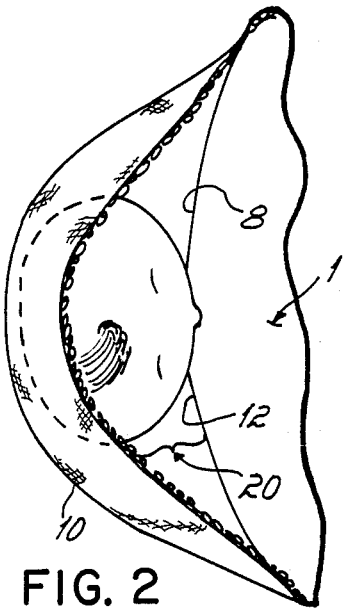
FIG. 2 is a transverse view along line 2—2 of FIG. 1 and shows the baby doll in position in the pouch.

The invention comprises a doll set including a mother doll 1 and the baby doll 2. (The set may also include appropriate clothes and other accessories for the mother and baby, not shown in the drawing.) Each doll is preferably a soft sculpture and apart from the pouch to be described, is of generally conventional outward appearance, with a head, arms, legs, and a trunk or torso. The trunk 5 of the mother has the form of a woman who is not pregnant, as indicated by the dashed line 8 in FIG. 1. The mother has a baby carrying pouch 10 which is preferably formed not on her torso but rather is provided in a permanent or removable undergarment 11 which may be in the form of a chemise which fits over the trunk of the mother.

The pouch or pocket 10 is located over (or on) the abdomen area 12 of the mother's trunk, and is preferably formed on the undergarment 11, but it may alternatively be formed on the trunk itself. It is preferred that this pouch be closed at the sides and top, and that it open downwardly adjacent the lower end of the trunk 5, to facilitate placing the baby doll in the pouch. However, whether pouch 10 is provided in the undergarment 11 or is formed directly on the trunk 5 of the mother doll itself, it is preferably formed of an expansible, resilient, pliable material such as an elasticized or stretchable fabric. Spandex, stretchable knits, and fabric with elastic bands sewn thereon are examples of such materials. In its normal position the pouch 10 is constructed so that it hugs and conforms to the torso corresponding approximately to line 8; but it is dimensioned and shaped so that it can expand to receive the baby 2 in it.

It is preferred that the pocket 10 open downwardly as shown, with the opening 20 running horizontally just above the legs of the mother doll. However, it is also contemplated that the pocket can open from the front, side or top if desired, although these are less convenient for placing the baby within the pocket under clothes being worn by the mother. It is understood that the mother is dressable in either appropriately sized maternity clothes to fit over the baby in the pouch, or in ordinary clothes when the baby is not in the pocket. These clothes are not shown in the drawings and may be conventional doll clothes.

Figure 3:
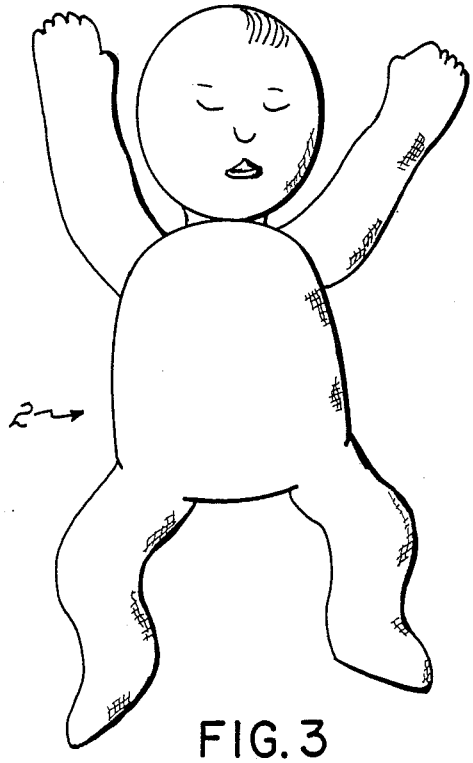
FIG. 3 is a front view of a baby doll in accordance with a preferred embodiment of the invention.

The baby 2, shown in FIG. 3, has arms and legs which are pliable or foldable over its trunk in order to simulate a fetal position. The baby, so folded, is preferably placed upside down in the pouch, with its back surface 18 (see FIG. 1) facing forwardly. The back of the doll should be gently rounded so that this rounded shape will translate through the material of the pocket to impart a smooth gently rounded realistically appearing pregnant look to the mother, as seen in FIG. 1.

The baby is preferably placed upside down in the pouch; but the pouch may be sized to receive the baby doll in other positions since young children are not likely to be biologically precise about this.

When the baby is in the pocket of the mother, it bulges the pocket and the mother appears pregnant; when the baby is removed the mother appears attractively svelte, and this change is accomplished in a natural manner without having to use the cams or springs of pregnant dolls of the prior art.

Having described the invention, what is claimed is:

1. A doll set comprising a pregnant mother doll and separate baby doll, said mother doll having a head, trunk, arms and legs, the trunk having the profile of a woman who is not pregnant, and means presenting an elastically expansible and contractable external pouch on the abdomen area of the trunk, said means being of stretchable fabric material, said pouch being presented in an undergarment which is fitted snugly over the trunk of the mother doll, said pouch opening downwardly just above the legs of the mother doll and dimensioned to receive and hold said baby doll within it to simulate the shape of a pregnant woman, said pouch being contracted elastically so as to conform to an assume the shape of said trunk so that the mother doll appears trim and not pregnant when the baby doll is not within said pouch, said baby doll being dimensioned and shaped to fit within the pouch and, when in the pouch, to impart a rounded appearance to the pouch so as to simulate pregnancy of the mother doll.

2. A doll set according to claim 1 wherein the baby doll is a soft sculpture and has pliant arms and legs which can be folded against it for placement in said pouch.

3. A doll set according to claim 1 wherein both the mother doll and the baby doll are soft sculptures.

4. A doll set according to claim 1 wherein said baby doll has a head, a body, arms, and legs, the arms and legs of the baby doll being foldable against its said body, said baby doll when its arms and legs are so folded presenting a rounded back, said pouch sized to receive said baby doll facing toward the mother doll in such folded position with said rounded back facing outwardly, thereby to simulate the pregnant appearance of the mother doll.

* * * * *